US006261046B1

(12) United States Patent
Fryman

(10) Patent No.: US 6,261,046 B1
(45) Date of Patent: Jul. 17, 2001

(54) REFUSE COLLECTION VEHICLE WITH SAFETY HOOKS

(75) Inventor: Richard Scott Fryman, West Chester, OH (US)

(73) Assignee: Rumpke Consolidated Companies, Inc., Cincinnati, OH (US)

( * ) Notice: Subject to any disclaimer, the term of this patent is extended or adjusted under 35 U.S.C. 154(b) by 0 days.

(21) Appl. No.: 09/447,394

(22) Filed: Nov. 22, 1999

(51) Int. Cl.[7] ..... B65F 3/02

(52) U.S. Cl. ..... 414/410; 414/810; 414/407; 414/420; 414/559

(58) Field of Search ..... 414/810, 420, 414/419, 559, 421, 422, 423, 424, 407, 425, 410, 406, 554; 220/1.5

(56) References Cited

U.S. PATENT DOCUMENTS 3,658,199 * 4/1972 Owen, Jr. ..... 414/406 X
3,702,662 * 11/1972 Davieau ..... 414/406 X
3,709,389 * 1/1973 Stelz ..... 414/410
3,765,555 * 10/1973 McKenzie et al. ..... 414/410
5,784,947 7/1998 Bayne et al. .

OTHER PUBLICATIONS

Richard Scott Fryman, *Declaration*, Mar. 9, 2000.

* cited by examiner

*Primary Examiner*—Frank E. Werner
(74) *Attorney, Agent, or Firm*—Wood, Herron & Evans, L.L.P.

(57) ABSTRACT

A refuse collection vehicle comprising a vehicle body supported by wheels and a hopper secured to the vehicle body. The hopper has a bumper lip at the rear thereof of a fixed height to which are secured at least two safety hooks. The safety hooks help prevent a pivot bar of a refuse container from moving rearwardly while the refuse container is being emptied. The safety hooks also help prevent accidental spillage of the contents of the container during the emptying procedure.

15 Claims, 5 Drawing Sheets

REFUSE COLLECTION VEHICLE WITH SAFETY HOOKS

FIELD OF THE INVENTION

This invention relates to vehicles for collecting refuse and, more particularly, to such vehicles having hoppers secured to the rear of the vehicles.

BACKGROUND OF THE INVENTION

Various devices have been developed for use on refuse collection vehicles in order to aid in the collection of refuse from a plurality of refuse containers. Commonly, the vehicle designed to collect and store the refuse has a hopper secured to the rear of the vehicle. The purpose of the hopper is to collect the refuse from the refuse containers without the refuse spilling onto the street or ending up in other undesirable locations. Consequently, various devices have been developed for ensuring a smooth, efficient and safe transition of the refuse from the interior of a container into the hopper of the collection vehicle.

One of these devices which has been used for some time is a two-piece latch which is secured to the rear of the hopper. A pair of these two-piece latches are located on the hopper spaced from one another. Once the refuse collection vehicle is backed up to a position adjacent a refuse container, the refuse container is lifted upwardly using any of numerous devices. Each refuse container has a front pivot bar which is located inside the two-piece latches when the latches are closed. The pivot bar of the container engages a site on the vehicle to permit rotation of the container relative to the vehicle, thereby dumping the refuse from inside the container to the hopper. To ensure that the front pivot bar of the refuse container does not pull rearwardly away from the hopper, each of the two-piece latches must be closed by an operator before the refuse container is lifted. To close such a latch an operator must first lift the arm of the latch upwardly into engagement with an upper part of the two-piece latch, thus locking the two pieces together and forming a loop in which one end of the pivot bar resides. Then the operator must walk around the refuse container to the other side of the refuse container and latch together the two pieces of the other latch before the refuse container may be lifted in order to empty its contents. Thus, the use of a vehicle having such latches requires a great deal of time and effort on the part of the operator, who in the course of a day may empty hundreds of refuse containers.

In addition to preventing the refuse from spilling onto the ground, such latches are theoretically designed to prevent the pivot bars of the refuse container from moving rearwardly and creating a risk of striking the operator. However, such two-piece latches often become bent or worn from use and fail to perform satisfactorily. Additionally, the operator may accidentally kick or bump into the lower bar of the latch when the lower bar is down.

Thus, a need exists for a mechanism on the rear of a hopper which will enable a refuse container to be emptied safely and efficiently without the refuse container moving suddenly backwardly away from the hopper.

Therefore, it has been one objective of the present invention to provide a safety mechanism for the user on a hopper of a refuse collection vehicle which allows refuse containers to be emptied safely and efficiently.

It has been a further objective of the present invention to provide a hopper for use on a refuse collection vehicle having a pair of safety hooks to retain a pivot bar of a refuse container while the refuse container is being emptied.

SUMMARY OF THE INVENTION

The invention of this application which accomplishes these objectives comprises a refuse collection vehicle which is capable of receiving and storing refuse from multiple containers. The refuse collection vehicle has a vehicle body supported by wheels and a hopper connected to the vehicle body. The hopper is used to receive and retain a sufficient quantity of refuse before it is compacted and transferred to the vehicle body. The hopper has a pair of opposed side walls and an interior cavity between the side walls for receiving and storing the refuse. Behind the interior cavity a bumper lip of a fixed height extends between the side walls. The bumper lip has an upper edge which is horizontally oriented and about which the containers are pivoted when they are emptied.

Each of the refuse containers used in accordance with the present invention has a rear bracket and a horizontally oriented pivot bar located at the front of the container and a hinged lid on the top of the container.

Different devices may be used to lift the refuse containers. One such device is a cable system secured to the vehicle. The refuse collection vehicle has a winch secured to the top of the vehicle body which is adapted to store a cable. One end of the cable is secured to the rear bracket of each container to be emptied after passing through a cable guide secured to the hopper of the vehicle. Once the cable is secured to the rear of the refuse container, the winch is activated, causing the cable to tighten and the rear of the container to be pulled upwardly and forwardly, the container pivoting about a horizontal axis. As the cable is pulling the rear of the container forwardly, the pivot bar of the container moves forwardly until the ends of the pivot bar contact a pair of guide ramps which are part of the hopper. Each of the guide ramps extends downwardly and rearwardly until it intersects with the bumper lip at an intersection. As the cable continues to move the rear of the refuse container upwardly and forwardly, the guide ramps guide the ends of the pivot bar into the intersections. As the cable further raises the rear of the container, the pivot bar is prevented from moving rearwardly over the top of the bumper lip by at least two safety hooks which are secured to the bumper lip.

The safety hooks are adapted to receive and retain end portions of the pivot bar of the refuse container to ensure that the pivot bar of the refuse container does not raise over the bumper lip as the container is being emptied. As depicted in the figures herein, each of the safety hooks is fixedly secured to the bumper lip in an inverted, substantially upright, fixed orientation so that a catch of each hook extends downwardly from an apex. Thus, the safety hooks prevent the container from moving rearwardly which could cause the contents of the container to spill onto the ground and the pivot bar of the container to injure an operator.

In a preferred embodiment of the invention two safety hooks are welded to an inside surface of the bumper lip and are of a height less than the height of the bumper lip. However, different methods of attachment of the safety hooks to the bumper lip may be used, and any number of safety hooks may be utilized in accordance with the present invention.

Once the container is emptied the cable is slowly unwound from the winch and gravity forces the rear end of the container downwardly slowly, the pivot bar of the container rotating about a horizontal axis. Due to the orientation of the front of the container and the orientation of the bumper lip, the pivot bar of the container is disengaged from the safety hooks and allowed to move upwardly and rearwardly to its original position.

The safety hooks of the hopper of the present invention therefore allow the contents of a refuse container to be emptied safely and efficiently into the hopper of a refuse collection vehicle without spillage. These and other objects and advantages of the present invention will be more apparent from the following description of the drawings.

BRIEF DESCRIPTION OF THE DRAWINGS

FIG. 3A illustrates a partially broken-away elevational view of the refuse collection vehicle having a cable secured to a full container with a closed lid;

FIG. 3B is a partially broken-away elevational view of the refuse collection vehicle of FIG. 3A and the container of FIG. 3A, the container being rotated about a pivot axis, the ends of the pivot bar of the container being engaged with guide ramps of the hopper of the vehicle; and FIG. 3C is a partially broken-away elevational view of the refuse collection vehicle of FIG. 3A and the container of FIG. 3A, the container having been rotated about a pivot axis and now in an emptied position.

DETAILED DESCRIPTION OF THE DRAWINGS

Figure 3C:
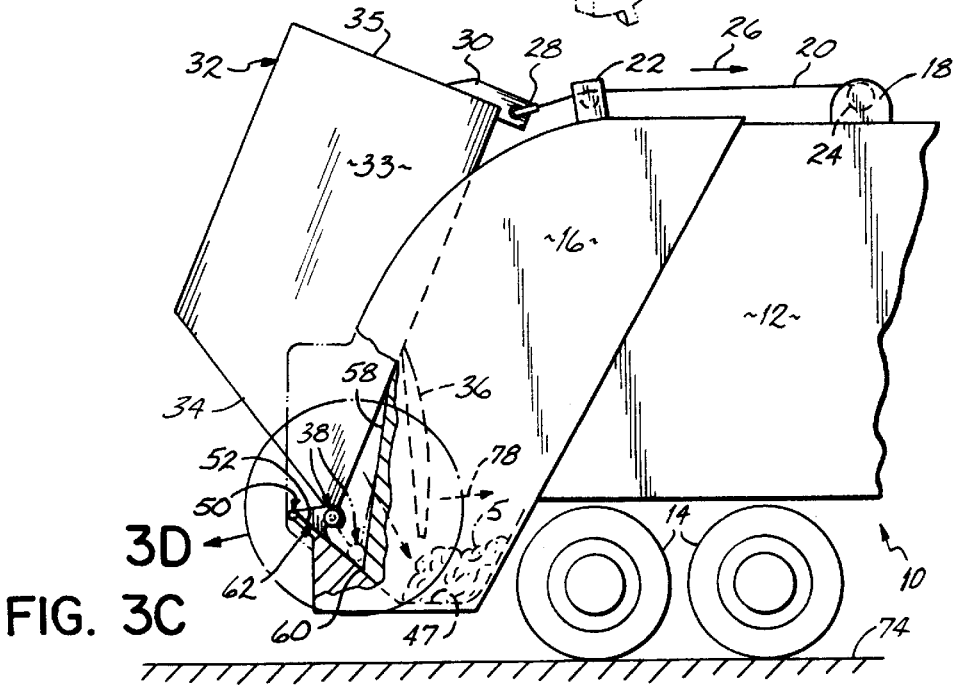
FIGS. 3A–3C illustrate the method of emptying a refuse container with the refuse collection vehicle of the present invention.
Figure 3A:
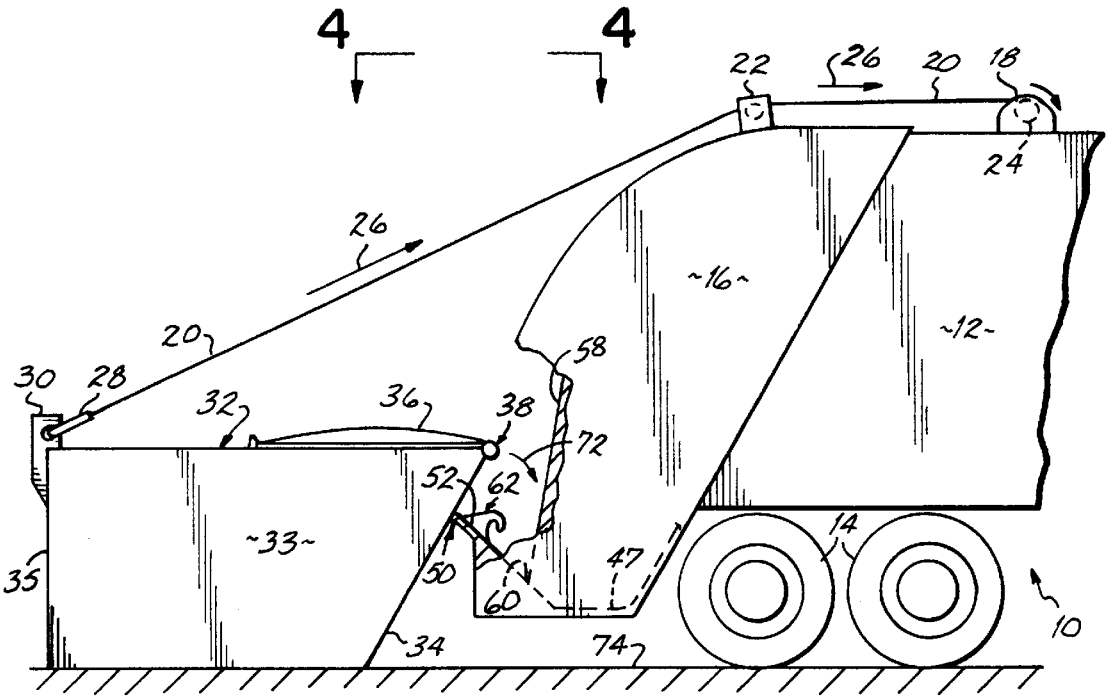
Figure 3B:
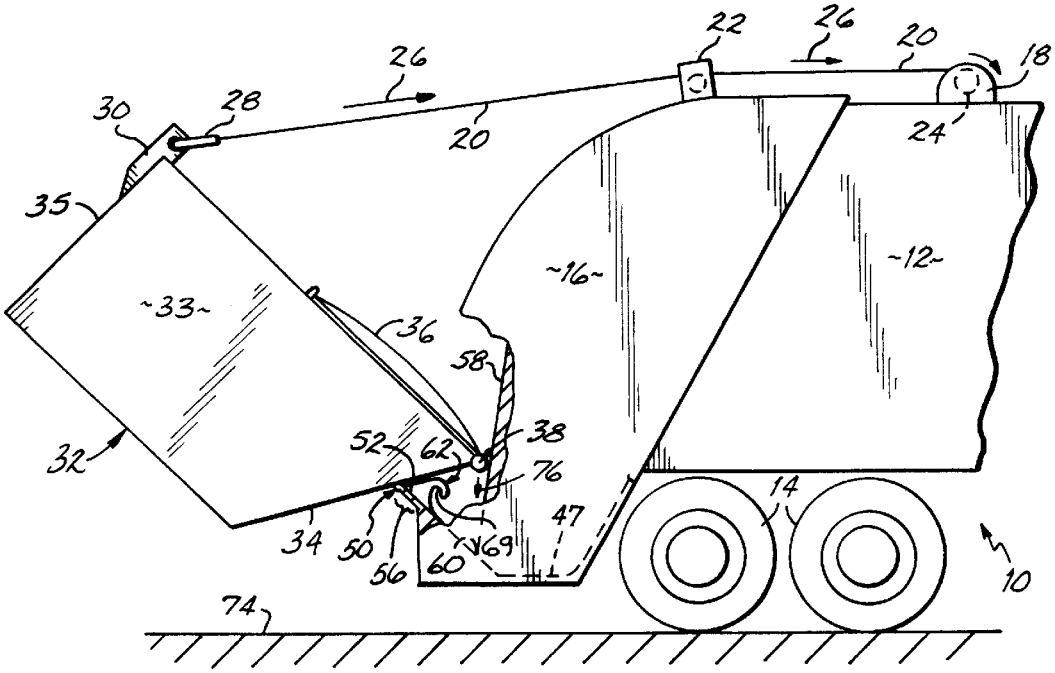

Referring to the drawings, and particularly to FIGS. 3A and 3B, the invention of the present application comprises a refuse collection vehicle 10 having a vehicle body 12 supported by wheels 14. Secured to the rear of the vehicle body 12 is a hopper 16 which is used to temporarily collect and store refuse from refuse containers before the refuse is compacted and then transferred into the interior of the vehicle body 12.

In order to aid in emptying the contents of numerous containers, a winch 18 is located on top of the vehicle body 12 and is used to store a cable 20 which passes over a cable guide 22 secured to the hopper 16. The winch 18 may be electrically or manually operated in order to wind the cable about a spool 24, moving the cable 20 in the direction of arrows 26. One end 28 of the cable is secured to a bracket 30 of a trash container or receptacle 32.

Figure 2:
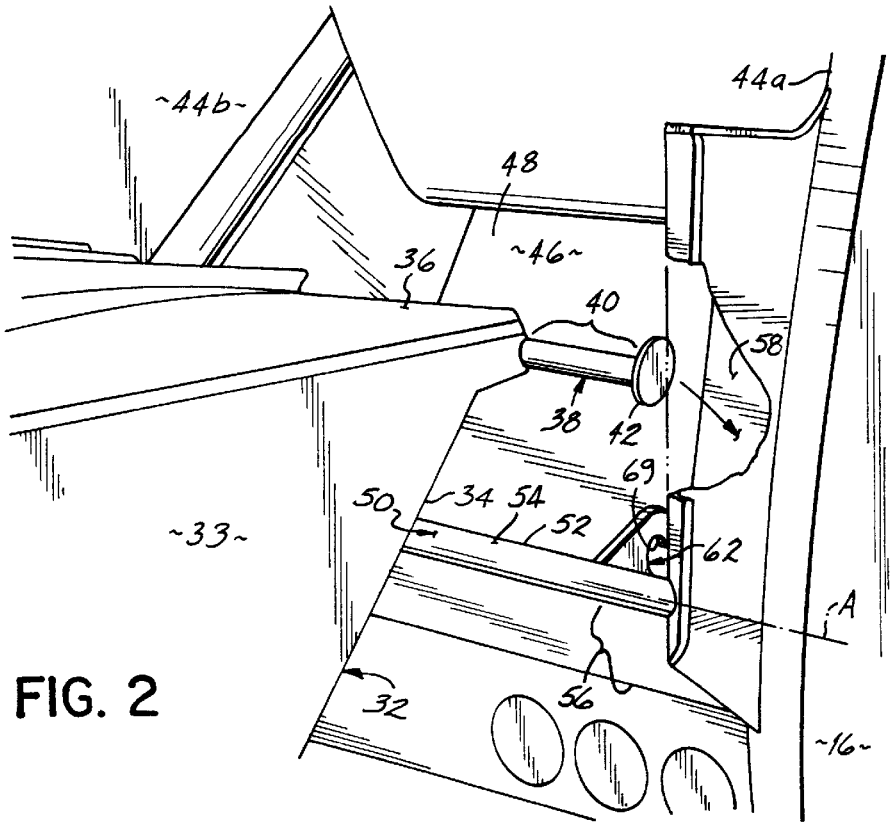
FIG. 2 is a perspective view of a portion of the hopper of the present invention and a portion of a container before the container is emptied.

The trash container 32 has a pair of side walls 33, a sloped front wall 34, a rear wall 35, at least one hinged lid 36 located on top of the container and a pivot bar 38 located at the front of the container 32. As illustrated in FIG. 2, the pivot bar 38 has two opposed end portions 40 which extend beyond the side walls 33 of the container. Each of the end portions 40 terminates in a rounded knob 42 (see FIG. 2). Although one round configuration of knob 42 is illustrated, the knobs 42 may assume any of numerous configurations, shapes and sizes.

Figure 3D:
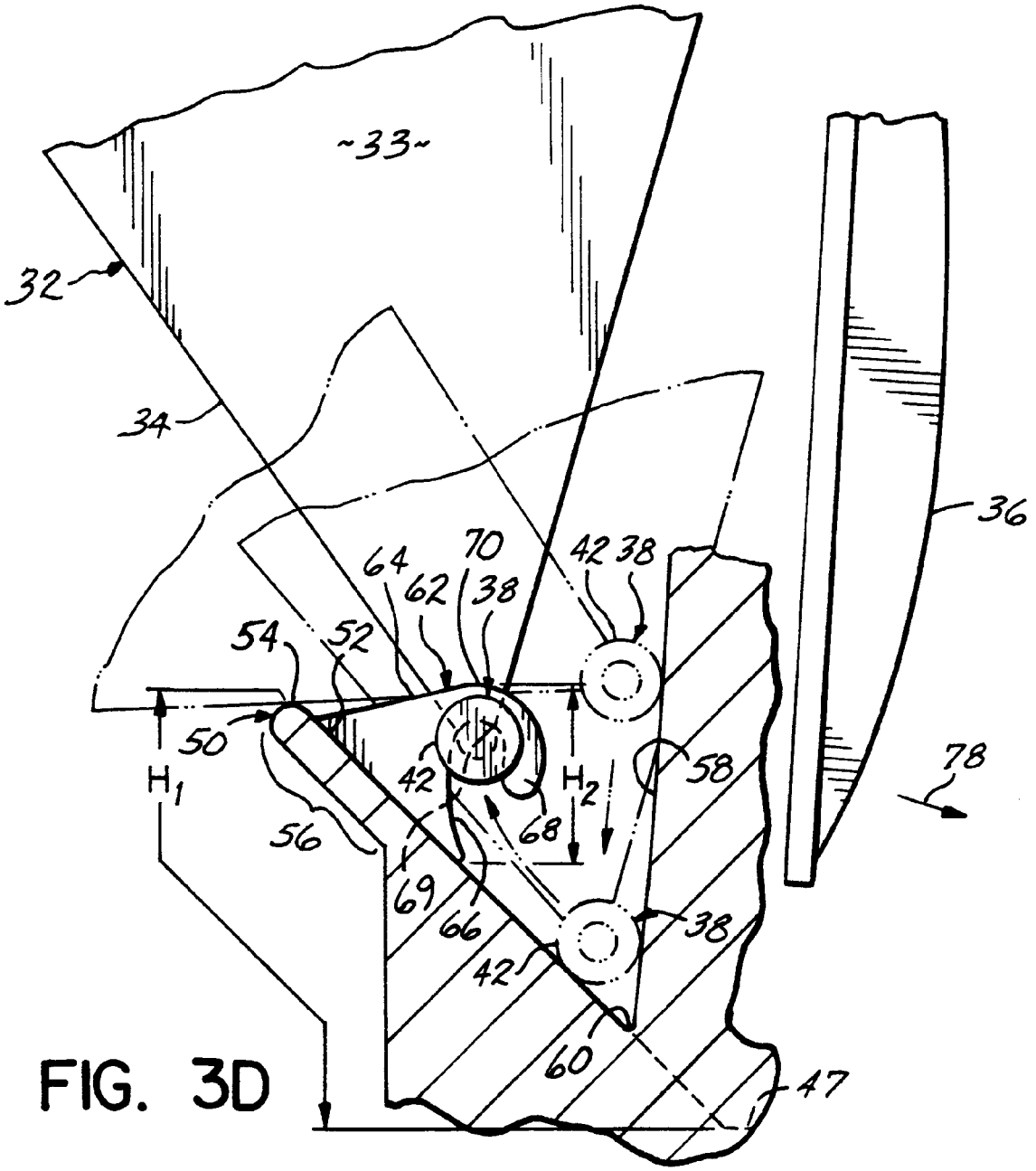
FIG. 3D is an enlarged view of the encircled area 3D of FIG. 3C.

As best illustrated in FIG. 2, the hopper 16 has a pair of opposed side walls 44*a* and 44*b*, a front wall 46 and a bottom 47 (see FIGS. 3A–3C), all of which define an interior cavity 48. Behind the interior cavity 48 is a bumper lip 50 extending between the side walls 44*a*,44*b* of the interior cavity 48. The bumper lip 50 extends upwardly and outwardly from the bottom 47 of the hopper's interior cavity 48 and has a generally planar interior surface 52 extending upwardly to an upper edge 54. This is best illustrated in FIGS. 2 and 3A. One of the purposes of the bumper lip 50 is to retain fluid inside the interior cavity 48 of the hopper 16 so that such fluid does not spill out onto the road surface. As illustrated in FIG. 3D, the bumper lip 50 has a fixed height $H_1$ extending upwardly from the bottom 47 of the interior cavity 48. The bumper lip 50 further has a relatively narrow lip portion 56 terminating in the upper edge 54 of the bumper lip 50.

Figure 4:
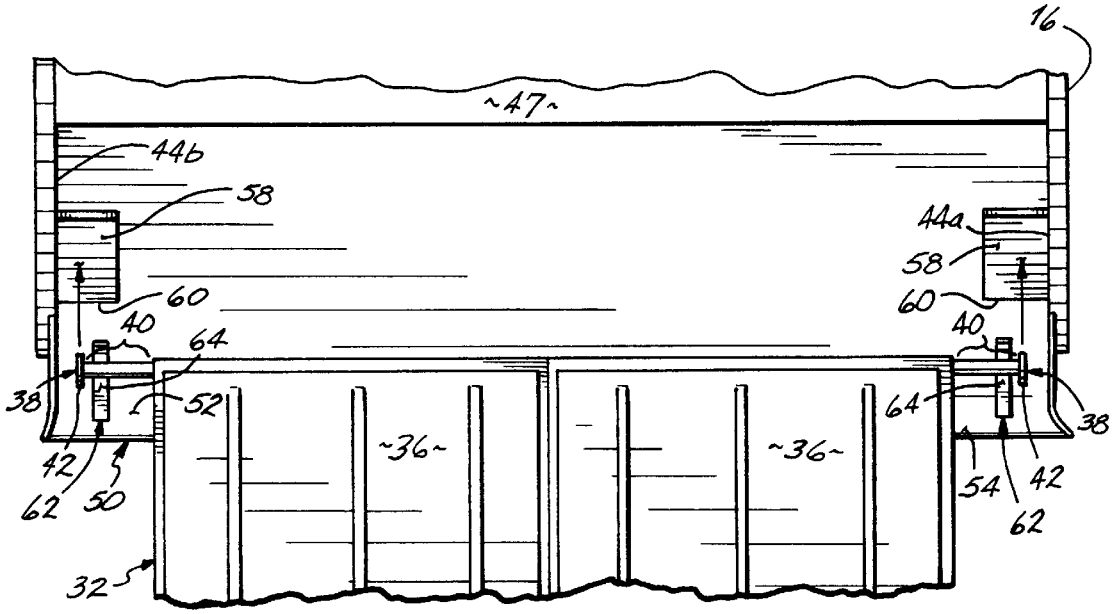
FIG. 4 is a view taken along the line 4—4 of FIG. 3A.

As best illustrated in FIGS. 2 ,3D and 4 the hopper 16 of the present invention further comprises a pair of guide ramps 58, one on each side of the hopper. As best illustrated in FIG. 4, each of the guide ramps 58 is located immediately inside one of the side walls 44*a*,44*b* of the hopper 16 and extends from front to back as it extends downwardly toward the bottom of the interior cavity 48. As best illustrated in FIG. 3D, each of these guide ramps 58 intersects with the bumper lip 50 at an intersection 60 in a generally V-shaped configuration, with the bottom of the V being the intersection 60. The purpose of the guide ramps 58 is to guide the knobs 42 of the pivot bar 38 of a container 32 downwardly as the rear of the container 32 is being lifted upwardly in order to empty the contents of the container.

The novel feature of the refuse collection vehicle 10 of the present invention is a pair of safety hooks 62 which are secured to the bumper lip 50 of the hopper 16. The safety hooks 62 (only one being shown in FIG. 2) are spaced from one another. These safety hooks 62 are adapted to receive and retain the pivot bar 38 of a refuse container 32 to ensure that the pivot bar 38 of the refuse container 32 does not raise over the bumper lip 50 as the container 32 is being emptied. As best illustrated in FIG. 3D, each of the safety hooks 62 has a height $H_2$ less than the height $H_1$ of the bumper lip 50. Each of the safety hooks 62 extends inwardly from the inside surface 52 of the bumper lip 50. The safety hooks 62 are preferably welded to the inside surface 52 of the bumper lip 50; however, the safety hooks 62 may be bolted onto the bumper lip 50 or secured in any other acceptable manner. As shown in the Figures, each of the safety hooks 62 is preferably fixedly secured to the bumper lip 50 in an inverted, substantially upright, fixed orientation and has an outer surface 64 and an inner surface 66, the inner surface 66 being adapted to receive and retain the end portion 40 of a pivot bar 38. However, it is expected that the orientation may be varied while still producing acceptable pivot bar retaining results. Furthermore, each of the safety hooks 62 has a catch 68 extending downwardly from an apex 70 in order to retain the pivot bar against the inner surface 66 of the safety hook as a container is being emptied.

The safety hooks 62 are preferably metal but may be made of numerous other materials. Additionally, the safety hooks 62 are preferably of a uniform thickness. Testing has shown that a ¾ inch thickness of "mild" steel, (type A36 steel) produces the desired strength to retain the pivot bars of standard size refuse containers while they are being emptied. However, other thicknesses may be employed depending on the composition of the safety hooks provided the hooks are able to retain the pivot bars of the refuse containers.

FIGS. 3A–3D illustrate the method of using the vehicle 10 of the present invention to empty a refuse container 32.

Referring to FIG. 3A, the vehicle 10 is backed up until the upper edge 54 of the bumper lip 50 contacts the front wall 34 of the refuse container 32, at which point the vehicle is stopped. The driver or operator (not shown) then secures one end of cable 20 to the rear bracket 30 of the container 32. The operator then tightens the cable 20 by activating the winch 18, causing the refuse container 32 to pivot about a horizontal axis A (see FIG. 2) which is the center of a radius defined by the arcuate upper edge 54 of the bumper lip 50, thus moving the pivot bar 38 of the container 32 in the direction of arrow 72 (clockwise as seen in FIG. 3A).

FIG. 3B illustrates the container 32 being lifted off the road surface 74, the pivot bar 38 of the refuse container 32 moving forwardly until the knobs 42 of the pivot bar 38 contact the guide ramps 58 located immediately inside the side walls 44*a*,44*b* of the hopper 16. As the cable 20 continues to pull the rear of the container 32 upwardly and forwardly, the knobs 42 of the pivot bar 38 continue to move downwardly in the direction of arrow 76 along the guide ramps 58, the container 32 pivoting about the horizontal axis A.

Referring now to FIGS. 3C and 3D, as the cable 20 is further moved in the direction of arrows 26, the container 32 continues to rotate about horizontal axis A. The knobs 42 of the pivot bar 38 of the container 32 continue downwardly along the guide ramps 58 of the hopper 16 into the intersections 60 of the guide ramps 58 and the bumper lip 50. The movement of the knobs 42 of the pivot bar 28 of the container 32 is illustrated by the dashed lines in FIG. 3D. In this position with the knobs 42 at their lowest point, one or more of the lids 36 of the refuse container 32 will open in a direction of arrow 78 and the refuse 5 will empty out of the container 32 and into the interior cavity 48 of the hopper 16. See FIG. 3C.

As best illustrated in FIG. 3D, as the cable 20 continues to tighten, moving the rear of the container 32 forwardly, the knobs 42 of the end portions 40 of the pivot bar 38 will move upwardly along the inside surface 52 of the bumper lip 50. The end portions 40 of the pivot bar 38 will engage the inner surfaces 66 of the safety hooks 62 inside the recesses 69 of the safety hooks. This position is illustrated in solid lines in FIG. 3D with the end portions 40 of the pivot bar 38 engaged with the safety hooks 62, thus preventing the pivot bar 38 of the container 32 from moving over the top of the bumper lip 50. Once the container 32 is empty, gravity will cause the rear of the container 32 to move downwardly as the cable 20 is relaxed, thus disengaging the end portions 40 of the pivot bar 38 from the safety hooks 62 and causing the end portions 40 of the pivot bar 38 to move downwardly and out of engagement with the safety hooks 62 as the container is being lowered. Thus, the container 32 is returned to its original position and the operator may unhook the end 28 of the cable 20 from the bracket 30 of the container 32, wind the cable 20 back up and drive to the next container to be emptied. Thus, the present invention enables an operator to quickly and easily empty several containers in succession.

Figure 1:
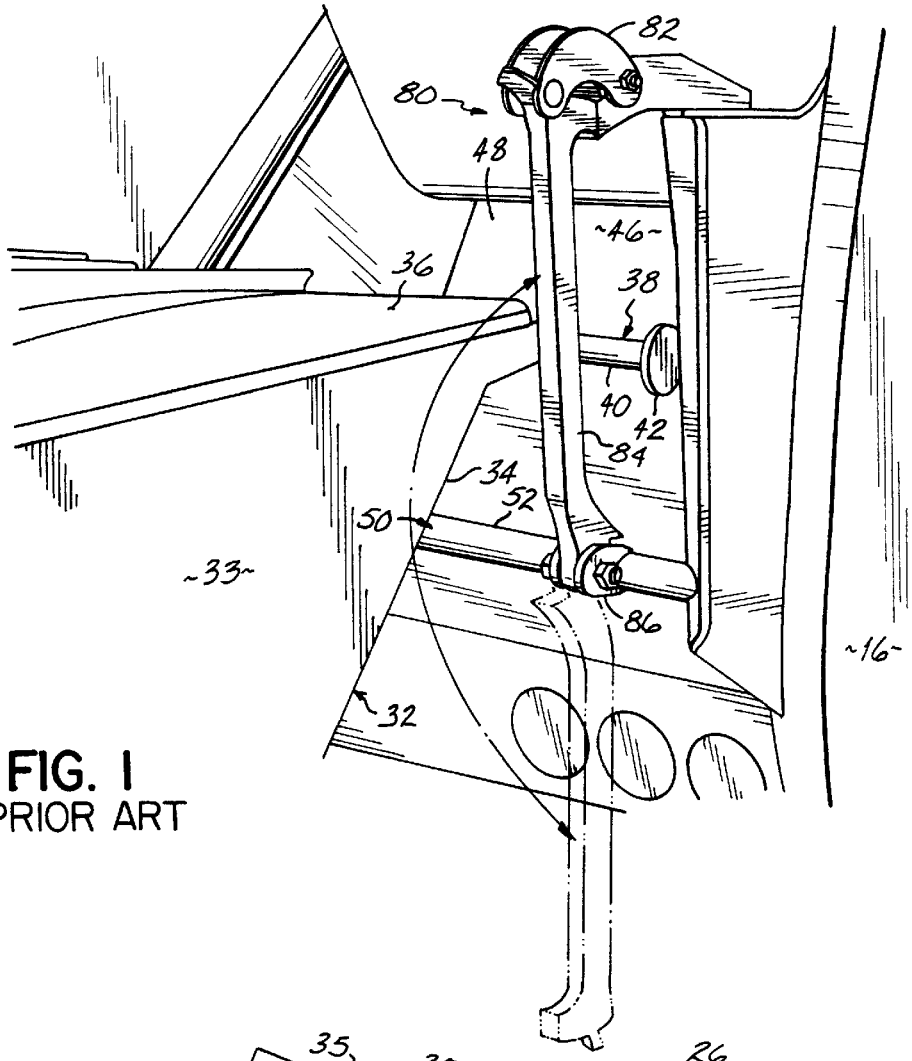
FIG. 1 PRIOR ART
FIG. 1 is a perspective view of one prior art mechanism used to retain the pivot bar of a refuse container.
Figure 1A:
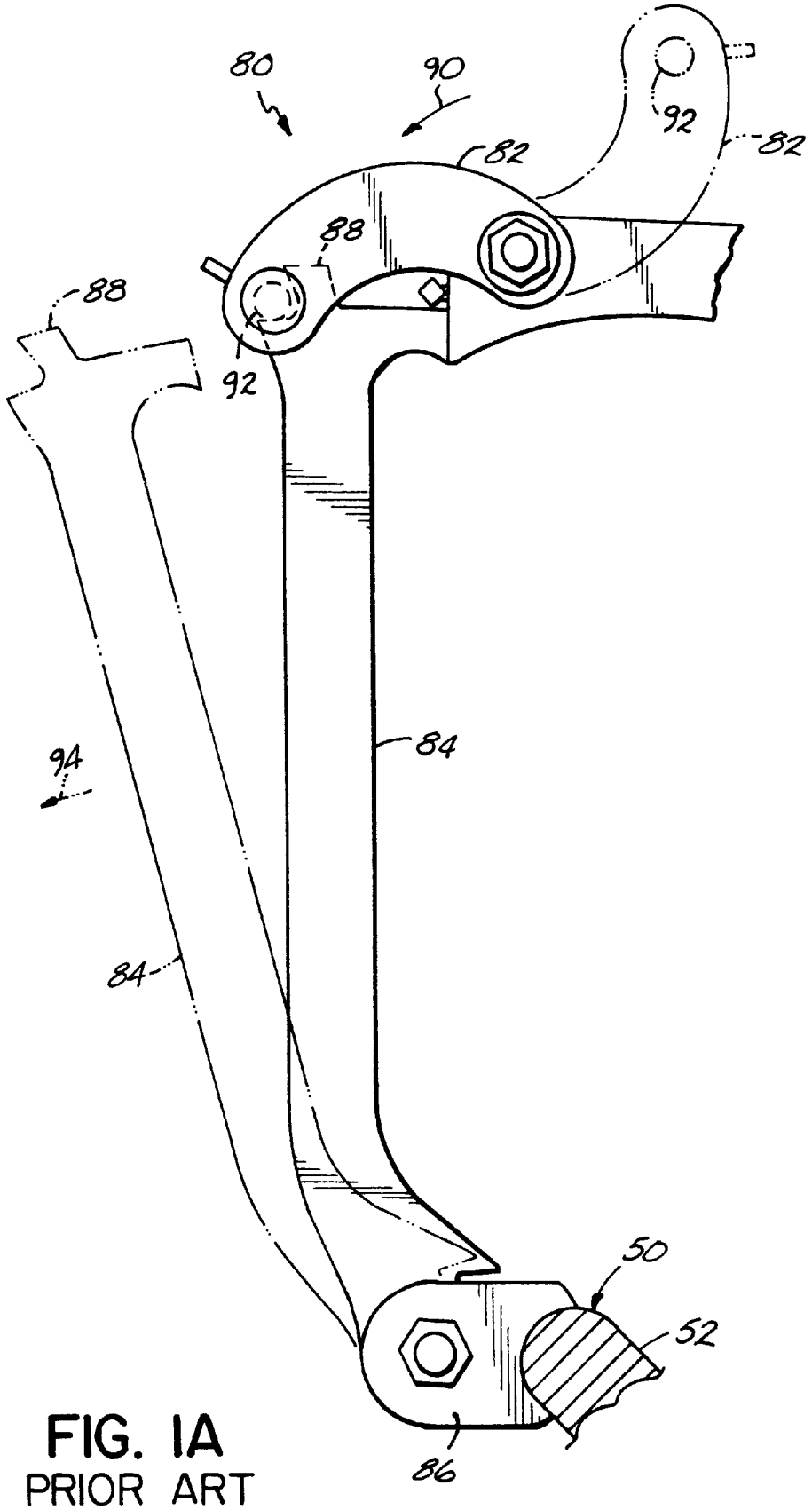
FIG. 1A PRIOR ART
FIG. 1A is a side elevational view of a portion of the prior art mechanism of FIG. 1.

The safety hooks 62 which are part of the hopper 16 of the present invention provide a much needed improvement over the prior art which is illustrated in FIGS. 1 and 1A. For the sake of simplicity, the same numerals used to describe the container and the hopper of the present invention used in FIGS. 2–3C will be used as required for the reader to gain an understanding of the prior art.

Referring to FIG. 1, the prior art includes a two-piece latch 80 secured to the bumper lip of a hopper. The latch 80 includes a pivotal upper piece 82 and a pivotal lower bar 84. The lower bar 84 is pivotally connected to the bumper lip 50 with a bracket 86. As best illustrated in FIG. 1A, the lower bar 84 has a stop 88 at the top thereof. When the vehicle is traveling, the lower bar 84 is in the down position illustrated in phantom lines in FIG. 1. When the operator reached the desired location proximate a container to be emptied, the operator would have to get out of the vehicle and raise the lower bar 84 to the position illustrated in solid lines in FIG. 1. As seen in FIG. 1A, in order to lock the latch 80, the driver would have to pivot the upper piece 82 of the latch 80 in the direction of arrow 90 so that a locking bar 92 was located immediately in front of the stop 88 of the lower bar 84. This locked position is illustrated in solid lines in FIG. 1A. In this locked position the lower bar 84 could not be pulled outwardly in the direction of arrow 94 by the pivot bar 38 of a container 32. Once the container was emptied, the operator had to manually unlock each latch before driving on to empty the next container. Thus, the latches 80 acted as a safety mechanism but required a great deal of time and effort to lock in a locked position and unlock once the container was emptied.

Due to the difficulties with the latches illustrated in FIGS. 1 and 1A, a need existed for a safety mechanism to aid in emptying refuse containers which was not so time consuming to operate. With applicant's invention, the operator no longer needs to lock and later unlock a latch on both sides of a refuse container, eliminating the need for the operator to walk around the container both before raising the container to empty it and after the emptying procedure is complete. With applicant's invention, the operator may operate the controls to lift the container once the cable is secured to the rear of the container.

Although the drawings illustrate a cable being used to lift the container of the present invention, any number of other mechanisms may be used to lift the container without departing from the spirit and scope of the present invention. While I have described only one preferred embodiment of the present invention, those skilled in the art will appreciate changes and modifications which may be made without departing from the scope of the present invention. Therefore, I do not intend to be limited except by the scope of the following claims.

I claim:

1. A refuse collection vehicle comprising:

a vehicle body supported by wheels, a hopper secured to said vehicle body, said hopper having a bottom, a front wall, a pair of opposed side walls and a bumper lip extending between said side walls defining an interior cavity for receiving and storing refuse, and at least two safety hooks secured to said bumper lip in a fixed orientation between said side walls of said hopper, each of said safety hooks having a downwardly directed recess, connection means extending rearwardly from said vehicle adapted to be secured to a refuse container having a pivot bar, said refuse container being located behind said vehicle, whereby upon tightening said connection means said refuse container rotates about a horizontal axis, emptying refuse from said refuse container into said interior cavity of said hopper, said pivot bar of said refuse container contacting guide means and subsequently engaging said safety hooks to ensure that said pivot bar of said refuse container does not raise over said bumper lip as said refuse container is emptied.

2. The refuse collection vehicle of claim 1 wherein each of said safety hooks have a height less than said height of said bumper lip.

3. The refuse collection vehicle of claim 1 wherein each of said safety hooks extends inwardly from an inside surface of said bumper lip.

4. The refuse collection vehicle of claim 1 wherein each of said safety hooks is fixedly secured to said bumper lip in an substantially upright orientation.

5. The refuse collection vehicle of claim 1 wherein each of said safety hooks has a catch extending downwardly from an apex.

6. The refuse collection vehicle of claim 1 wherein said guide means comprises a pair of opposed guide ramps.

7. The refuse collection vehicle of claim 1 wherein said safety hooks are welded to said bumper lip.

8. The refuse collection vehicle of claim 1 wherein said connection means is a cable.

9. A refuse collection vehicle comprising:

a vehicle body, a hopper secured to said vehicle body, said hopper having a bottom, a front wall, a pair of opposed side walls and a bumper lip extending between said side walls defining an interior cavity of said hopper, said interior cavity having an opening above said bumper lip, a pair of safety hooks fixedly secured to said bumper lip between said side walls of said hopper, each of said safety hooks having a downwardly directed recess, a cable extending rearwardly from said vehicle body adapted to be secured to a refuse container having a pivot bar, and means for tightening said cable wherein upon tightening said cable, said refuse container is rotated about a horizontal axis, causing refuse from said refuse container to fall into said interior cavity of said hopper through said opening, said pivot bar of said refuse container contacting guide means and subsequently engaging said safety hooks, preventing said pivot bar of said refuse container from raising over said bumper lip as said refuse container is emptied.

10. The refuse collection vehicle of claim 9 wherein said guide means comprises a pair of opposed guide ramps.

11. The refuse collection vehicle of claim 9 wherein said cable is wound upon a spool.

12. A refuse collection vehicle adapted to empty a refuse container, said vehicle comprising:

a vehicle body, a winch secured to said vehicle body, said winch being adapted to store a cable, one end of said cable being adapted to be secured to a refuse container behind said vehicle, a hopper secured to said vehicle body behind said vehicle body, said hopper having a bottom, a front wall, a pair of opposed side walls and a bumper lip of a fixed height extending between said side walls defining said interior cavity, said interior cavity having an opening above said bumper lip, and at least two safety hooks fixedly secured to said bumper lip between said side walls of said hopper, said safety hooks having downwardly turned recesses and being adapted to receive and retain a pivot bar of a refuse container to ensure that said pivot bar of said refuse container does not raise over said bumper lip as said cable pulls a rear end of said refuse container upwardly and forwardly in order to empty said refuse container into said interior cavity of said hopper through said opening, said pivot bar of said refuse container contacting guide members before engaging said safety hooks.

13. The refuse collection vehicle of claim 12 further comprising a cable guide secured to said hopper.

14. A method of emptying a refuse container having a pivot bar into a hopper secured to a refuse collection vehicle, said hopper having a bottom, a front wall, a pair of opposed side walls, and a rear wall comprising a bumper lip extending between said side walls, said bumper lip having at least two motionless safety hooks fixedly secured to an inside surface of said bumper lip between said side walls of said hopper, said method comprising:

securing one end of a cable wound around a winch secured to said refuse collection vehicle to a rear end of said refuse container, said cable passing over said hopper, and winding said cable around said winch, causing said refuse container to contact said bumper lip and pivot about a horizontal axis defined by an upper edge of said bumper lip, opposed ends of said pivot bar contacting said guide ramps of said hopper, further winding said cable around said winch, causing said opposed ends of said pivot bar of said refuse container to engage guide means and subsequently said safety hooks, said lid of said refuse container opening and gravity causing said contents of said refuse container to enter said interior cavity of said hopper.

15. A method of emptying contents of a refuse container into a hopper of a refuse collection vehicle, said refuse container having a pivot bar having a pair of opposed end portions, each of said end portions terminating in a knob, said hopper having a bottom, a front wall, a pair of opposed side walls, a pair of guide ramps adjacent said side walls and a rear wall comprising a bumper lip extending between said side walls, said bumper lip having at least two safety hooks fixedly secured to an inside surface of said bumper lip between said side walls of said hopper, each of said safety hooks having a downwardly turned recess, said method comprising:

securing one end of a cable wound around a winch secured to said refuse collection vehicle to a rear end of said refuse container, said cable passing over said hopper, tightening said cable, causing said refuse container to contact said bumper lip and pivot about a horizontal axis defined by an upper edge of said bumper lip, further tightening said cable causing said knobs of said end portions of said pivot bar to contact said guide ramps of said hopper, and further tightening said cable, causing said knobs of said pivot bar to engage inner surfaces of said safety hooks inside said recesses of said safety hooks after contacting said guide ramps, said lid of said refuse container opening and said contents of said refuse container entering said interior cavity of said hopper.

* * * * *